United States Patent [19]

Marchant

[11] Patent Number: 4,889,282

[45] Date of Patent: Dec. 26, 1989

[54] RAIL CLIP ASSEMBLY

[75] Inventor: Ian M. Marchant, Ashstead, England

[73] Assignee: GH International Ltd., Georgetown,

[21] Appl. No.: 133,018

[22] Filed: Dec. 15, 1987

[30] Foreign Application Priority Data

Dec. 17, 1986 [GB] United Kingdom ..... 8630068

[51] Int. Cl.[4] ..... E01B 9/00

[52] U.S. Cl. ..... 238/347; 238/331; 238/338; 238/349; 238/362

[58] Field of Search ..... 238/321, 323, 324, 331, 238/332, 333, 342, 343, 347, 361, 364, 310, 362, 363, 282, 338, 349, 307, 306, 303, 351; 403/408.1, 409.1

[56] References Cited

U.S. PATENT DOCUMENTS

| | | | |
|---|---|---|---|
| 866,743 | 9/1907 | Stoner | 238/362 |
| 983,939 | 2/1911 | Scott | 238/321 |
| 1,248,240 | 11/1917 | Alfreds | 238/321 |
| 1,447,622 | 3/1923 | McFarland | 238/324 |
| 1,697,398 | 1/1929 | Metcalf | 238/338 |
| 3,923,245 | 12/1975 | Marchant | 238/347 |
| 4,193,544 | 3/1980 | Marchant et al. | 238/347 |
| 4,251,030 | 2/1981 | Marchant | 238/347 |

FOREIGN PATENT DOCUMENTS

| | | | |
|---|---|---|---|
| 662939 | 7/1938 | Fed. Rep. of Germany | 238/347 |
| 385553 | 12/1932 | United Kingdom . | |
| 421418 | 12/1934 | United Kingdom . | |
| 529192 | 11/1940 | United Kingdom . | |
| 881898 | 11/1961 | United Kingdom . | |
| 1255412 | 12/1971 | United Kingdom . | |

*Primary Examiner*—Dennis H. Pedder
*Assistant Examiner*—Joseph D. Pape
*Attorney, Agent, or Firm*—Darby & Darby

[57] ABSTRACT

The present application describes a rail clip assembly, particularly but not exclusively for securing a crane rail to a flanged girder. The assembly comprises a first part adapted to be attached to the rail support surface adjacent the rail, a second part overlying the first part and having a lateral surface for abutment with a lateral face of the rail, and a bolt for fixing the second part to the first part independently of attachment of the first part to the rail support surface. The parts have aligned apertures through which the bolt extends, one of the apertures being elongate to enable the second part to assume different positions relative to the first part. The elongate aperture extends in a direction inclined at an acute angle to the longitudinal direction of the rail. The first and second parts have cooperating laterally directed surfaces which are abutted in all relative positions of the parts for transmitting to the first part laterally directed forces applied to the second part by the rail. The laterally extending surfaces extend parallel to the direction of extent of the elongate aperture. The first part has parallel upper and lower surfaces and the second part has an upper surface which, adjacent the aperture, is inclined to the horizontal away from the direction of approach of the cooperating laterally directed surfaces to the rail. The bolt extends through the apertures in a direction perpendicular to the inclined surface of the second part and is thus inclined with respect to the vertical.

4 Claims, 2 Drawing Sheets

RAIL CLIP ASSEMBLY

The present invention relates to a rail clip assembly, particularly but not exclusively for securing a crane rail to a flanged girder.

According to the present invention there is provided a rail clip assembly for securing a rail to a rail support surface, comprising a first part adapted to be attached to the rail support surface adjacent the rail, a second part overlying the first part and having a lateral surface for abutment with a lateral face of the rail, and fixing means for fixing the second part to the first part independently of attachment of the first part to the rail support surface, wherein the parts have aligned apertures therethrough through which the fixing means extends, one of the apertures being elongate to enable the second part of assume different positions relative to the first part, the elongate aperture extending in a direction inclined at an acute angle to the longitudinal direction of the rail, the first and second parts having cooperating laterally directed surfaces which are abutted in all relative positions of the parts for transmitting to the first part laterally directed forces applied to the second part by the rail, the said laterally extending surfaces extending parallel to the direction of extent of the elongate aperture, the first part having parallel upper and lower surfaces, the second part having an upper surface which, adjacent the aperture, is inclined to the horizontal away from the direction of approach of the cooperating laterally directed surfaces to the rail, and the fixing means extending through the apertures in a direction perpendicular to the inclined surface of the second part and thus inclined with respect to the vertical.

Preferably the fixing means includes a fixing member having a shank and an enlarged head for engagement in the first part, and the aperture in the first part opens at its lower end in a recess dimensioned to receive the enlarged head of the fixing member.

Preferably, the elongate slot is provided in the first part, the depth of the slot decreasing along its length as the thickness of the second part increases. Thus, the bottom of the slot remains parallel to the upper surface of the second part in all relative positions of the two parts.

Preferred embodiments of the invention will now be described in detail, by example only, with reference to the accompanying drawings, wherein.

Figure 1:
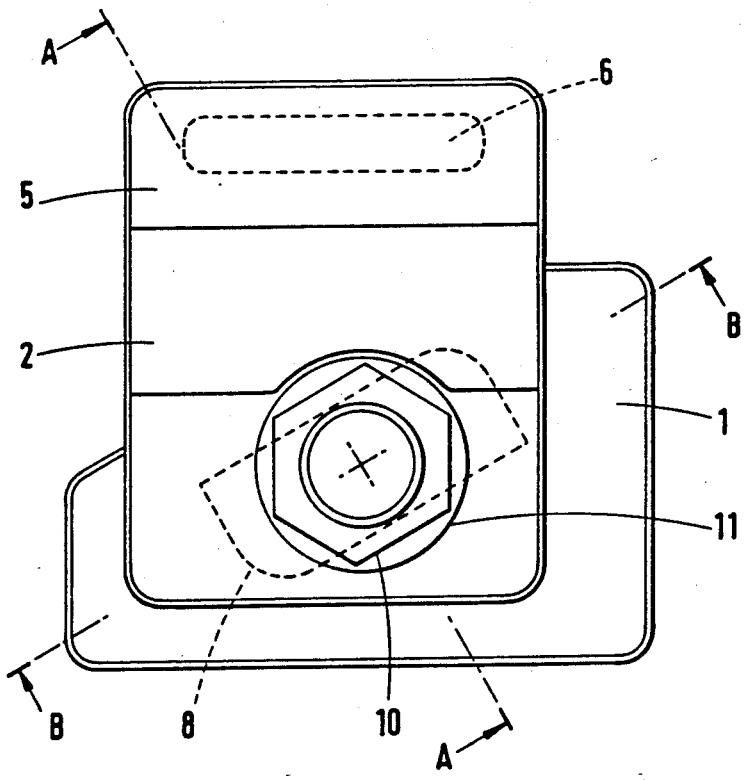
FIG. 1 is a plan view of a rail clip assembly in accordance with the invention.

The rail clip assembly comprises first part 1 which has the general shape of a rectangle with one corner cut off. First part 1 has a planar lower surface for bearing on the rail support surface. The part 1 is welded to the rail support in an approximate position relative to the rail by one or more welds (not shown) extending around its periphery. A generally rectangular second part 2 overlies the first part 1 and has a lateral surface 3 for abutment with the lateral face 4 of the rail flange. In this embodiment the part 2 is formed with an extension 5 which overlies the rail foot The extension 5 may include a resilient member 6 on its underside which bears on the rail, if it is desired that the clip assembly should positively locate the rail and resist upward movement. If the clip assembly is required only to prevent excessive upward movement, the member 6 is omitted.

The parts 1,2 are fixed together by a "T"-head bolt 7 whose head 7*a* is located in a recess 8*a* in the under side of the part 1 and which projects through apertures 8, 9 in the parts 1, 2 respectively. Aperture 8 opens at its lower end into recess 8*a*. A nut 10 with an optional washer 11 is engaged on the upper threaded end of the bolt 7. The aperture 8 in part 1 is elongate in a direction included to the direction of extent of the rail. Thus part 2 can be moved relative to part 1 to accommodate variations in the positioning of part 1 relative to the rail and to permit repositioning of the rail.

The contacting surfaces of the parts 1 and 2 include opposed laterally directed surfaces 12, 13 which extend parallel to the directions of extent of the aperture 8. They are thus arranged to be abutted in all relative positions of the parts 1 and 2 and allow laterally directed forces exerted by the rail on the part 2 to be communicated via the abutted faces 12, 13 to part 1 and thereby to the rail support It will be understood that the fixing means, e.g. the bolt 7 and nut 10, play no part in directly resisting lateral forces on the clip assembly.

Figure 2:
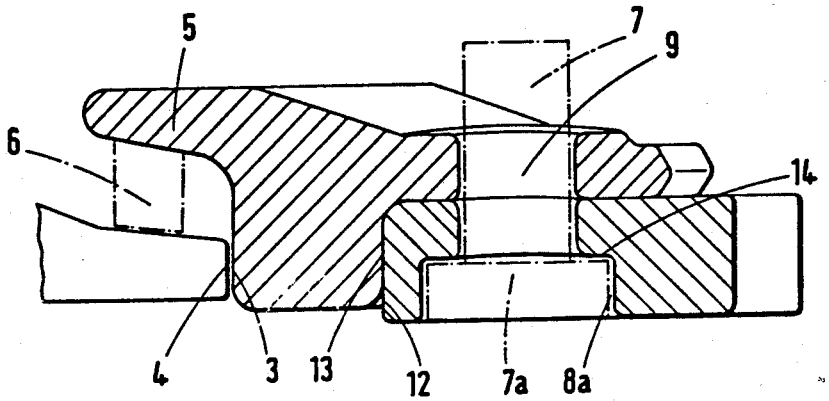
FIG. 2 is a sectional view along line A—A in FIG. 1.
Figure 3:
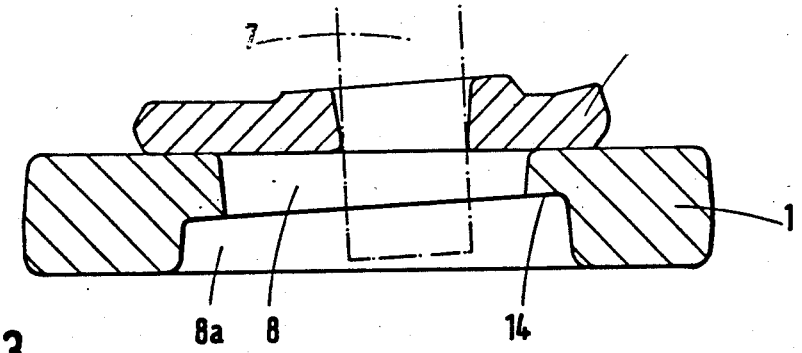
FIG. 3 is a sectional view along line B—B in FIG. 1.
Figure 4:
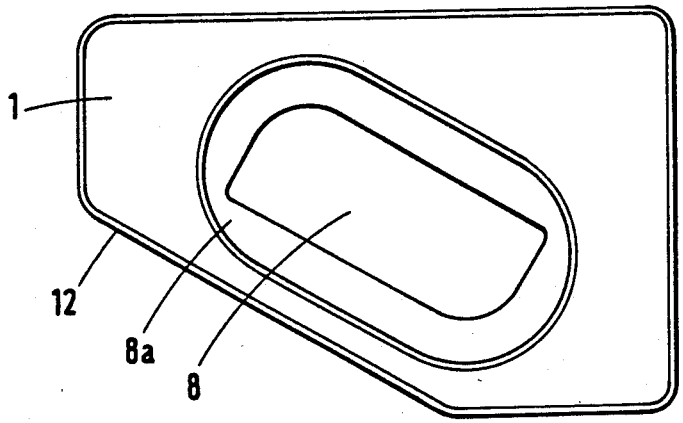
FIGS. 4 and 5 are plan views showing the undersides of the first and second parts of the assembly respectively.
Figure 5:
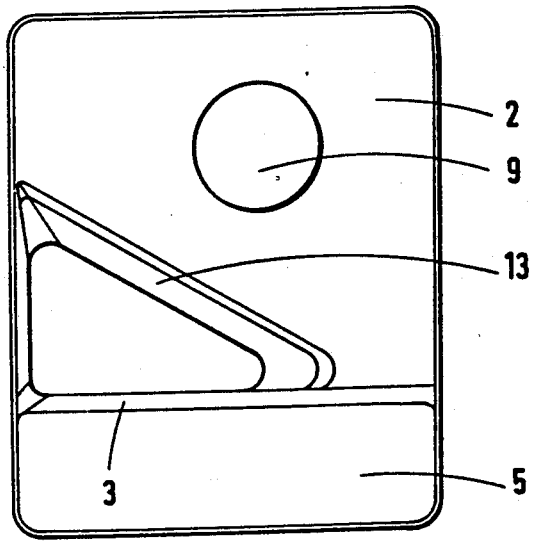

While one pair of abutted surfaces is provided in the embodiment illustrated in FIGS. 1 to 5, it will be understood that two or more such pairs of surfaces may be provided.

The part 2 is generally wedge-shaped, increasing in thickness in the direction of approach of the faces 12,13 and the aperture 8 to the rail. As used herein, the direction of approach refers to the fact that the surfaces 12, 13 get nearer or approach the rail in the direction from left to right as taken in FIG. 1. Accordingly, should relative movement occur between the parts 1 and 2 due to lateral forces applied by the rail, the movement will cause an increase in the tension in the bolt 7 and therefore increase frictional forces between the two parts 1 and 2, to resist further lateral movement.

The upper surface of the first part 1 is parallel to its lower surface. In order to maintain the edge 14 of the recess 8*a* parallel to the upper surface of the second part, the depth of the slot 8 decreases as the thickness of the second part 2 increases. Thus, bending of the bolt 7, as the two parts move relative to one another, is avoided.

Since the edge 14 of the recess 8*a* and the upper surface of the second part are inclined with respect to the horizontal, it will be appreciated that the bolt 7 is inclined with respect to the vertical, for example by 3°.

The above described clip assembly is designed to resist laterally directed forces of up to about 30 tons. The part 1 may be made of forged or cast steel, part 2 may be made of forged or cast steel or ductile ion, and the member 6 (if provided) may be made of rubber or an elastomeric material.

In a modification of the above described clip assembly (not shown), the part 1 is designed to be secured to the rail support by friction grip bolts. To this end the part 1 is made longer and is provided with apertures in its four corners for receiving such bolts.

The above described embodiments may be modified to include two or more fixing bolts, the first part 1 being provided with two or more elongate apertures 8 and the second part 2 being provided with corresponding apertures 9.

What I claim is:

1. A rail clip assembly for securing a rail to a rail support surface, comprising a first part adapted to be attached to the rail support surface adjacent the rail, a second part overlying the first part and having a lateral surface for abutment with a lateral face of the rail, and fixing means for fixing the second part to the first part independently of attachment of the first part to the rail support surface, wherein the parts have aligned apertures therethrough through which the fixing means extends, one of the apertures being elongate to enable the second part to assume different positions relative to the first part, the elongate aperture extending in a direction inclined at an acute angle to the longitudinal direction of the rail, the first and second parts having cooperating substantially laterally directed surfaces which are abutted in all relative positions of the parts for transmitting to the first part laterally directed forces applied to the second part by the rail, the said laterally extending surfaces extending parallel to the direction of extent of the elongate aperture, the first part having parallel upper and lower, surfaces, the second part having an upper surface which, adjacent the aperture, is inclined with respect to the horizontal so that the second part increases in thickness along the direction of the cooperating laterally directed surfaces, and the fixing means extending through the apertures in a direction perpendicular to the inclined surface of the second part and thus inclined with respect to the vertical.

2. An assembly according to claim 1, wherein the fixing means includes a fixing member having a shank and an enlarged head for engagement in the first part, and wherein the aperture in the first part opens at its lower end in a recess dimensioned to receive the enlarged head of the fixing member.

3. An assembly according to claim 1, wherein the elongate aperture is provided in the first part, the depth of the aperture decreasing along its length as the thickness of the second part increases.

4. An assembly according to claim 2, wherein the elongate aperture is provided in the first part, the depth of the aperture decreasing along its length as the thickness of the second part increases.

* * * * *